US007289757B2

(12) United States Patent
Sharma et al.

(10) Patent No.: US 7,289,757 B2
(45) Date of Patent: Oct. 30, 2007

(54) SHARED HIGH VOLTAGE POWER SUPPLY FOR IMAGE TRANSFER IN AN IMAGE FORMING DEVICE

(75) Inventors: Pramod K. Sharma, Lexington, KY (US); Mark Kevin DeMoor, Lexington, KY (US); Gregory Lawrence Ream, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 216 days.

(21) Appl. No.: 10/810,730

(22) Filed: Mar. 26, 2004

(65) Prior Publication Data

US 2005/0214034 A1 Sep. 29, 2005

(51) Int. Cl.

| | |
|---|---|
| ***G03G 15/01*** | (2006.01) |
| ***G03G 15/16*** | (2006.01) |
| ***G03G 15/00*** | (2006.01) |

(52) U.S. Cl. ..... 399/299; 399/66; 399/88

(58) Field of Classification Search ..... 399/66, 399/88, 223, 231, 298, 299, 302, 306, 308, 399/312

See application file for complete search history.

(56) References Cited

U.S. PATENT DOCUMENTS

| | | | | |
|---|---|---|---|---|
| 4,535,291 | A * | 8/1985 | Lee et al. | 324/320 |
| 5,376,998 | A | 12/1994 | Suzuki | |
| 5,794,110 | A * | 8/1998 | Kasai et al. | 399/299 |
| 5,862,438 | A | 1/1999 | Folkins | |
| 6,021,287 | A | 2/2000 | Tanaka | |
| 6,075,965 | A * | 6/2000 | Tombs et al. | 399/308 |
| 6,148,159 | A | 11/2000 | Shiraishi | |
| 6,324,374 | B1 * | 11/2001 | Sasamoto et al. | 399/298 |
| 6,330,405 | B1 | 12/2001 | Ishis et al. | |
| 6,421,521 | B2 * | 7/2002 | Tanaka | 399/299 |
| 6,442,356 | B2 * | 8/2002 | Omata et al. | 399/66 |
| 6,479,999 | B1 * | 11/2002 | DeMeester et al. | 324/318 |
| 6,505,014 | B2 | 1/2003 | Aoki et al. | |
| 6,522,861 | B2 * | 2/2003 | Tokutake et al. | 399/401 |
| 6,556,802 | B2 * | 4/2003 | Sasamoto et al. | 399/299 |
| 6,633,733 | B2 * | 10/2003 | Mochimaru et al. | 399/45 |
| 6,768,891 | B2 * | 7/2004 | Sasamoto et al. | 399/228 |
| 6,799,010 | B2 * | 9/2004 | Namiki | 399/298 |
| 6,839,532 | B2 * | 1/2005 | Hoashi | 399/167 |
| 2001/0043817 | A1 | 11/2001 | Maebashi | |

* cited by examiner

*Primary Examiner*—Brij Shrivastav
*Assistant Examiner*—Dixomara Vargas
(74) *Attorney, Agent, or Firm*—Coats & Bennett, PLC

(57) ABSTRACT

An image transfer assembly in a color printer or the like includes four image forming units. Each of the image forming units includes a photoconductive unit and a transfer device. A voltage is applied to the transfer device thereby creating a voltage potential between the photoconductive unit and the transfer device to facilitate the transfer of toner to a media substrate, such as paper. The transfer devices in the first two image forming units share a single high voltage power supply while separate high voltage power supplies supply the necessary voltage to the transfer devices of the other two image forming units.

29 Claims, 6 Drawing Sheets

SHARED HIGH VOLTAGE POWER SUPPLY FOR IMAGE TRANSFER IN AN IMAGE FORMING DEVICE

BACKGROUND

The invention relates generally to an image forming device, and more particularly, to an image forming device having a shared high voltage power supply.

An image forming device, such as a color printer, typically includes four units associated with four colors, black, magenta, cyan and yellow. Each unit includes a laser printhead that is scanned to provide a latent image on the charged surface of a photoconductive unit. The latent image on each unit is developed with the appropriate color toner and is then transferred to either an intermediate transfer medium or directly to a substrate (such as paper) that travels past the photosensitive units. The resulting full-color image is dependent on the combination of each color toner transferred to the substrate one line at a time. The toner on the substrate is then fused to the substrate in a fuser assembly, and the substrate is transported out of the printer. Thus, in a typical multi-color laser printer, the substrate receives color images generated at each of the four image units.

The image forming device, like all consumer products, should be constructed in an economical manner. Price is one of the leading factors when a user makes a purchasing decision. Further, quality of the resulting product is another factor for users. Cost and quality are thus guiding factors in the design and manufacture of image forming devices.

SUMMARY

The present invention relates to an image transfer assembly for use with an image forming device. The image transfer assembly includes a plurality of image forming units transferring print material to a media substrate. Each of the image forming units includes a photoconductive unit and a transfer device positioned to receive the media substrate therebetween. The image transfer assembly further includes a first power supply coupled to at least two of the transfer devices supplying a voltage thereto.

According to another aspect of the present invention, a method of printing includes moving a media substrate to a first image forming unit. A first voltage from a first power supply is applied to the first image forming unit facilitating the transfer of a first print material from the first image forming unit to the media substrate. The media substrate is moved to a second image forming unit. The first voltage from said first power supply is applied to the second image forming unit facilitating the transfer of a second print material from the second image forming unit to the media substrate.

DETAILED DESCRIPTION

Figure 1:
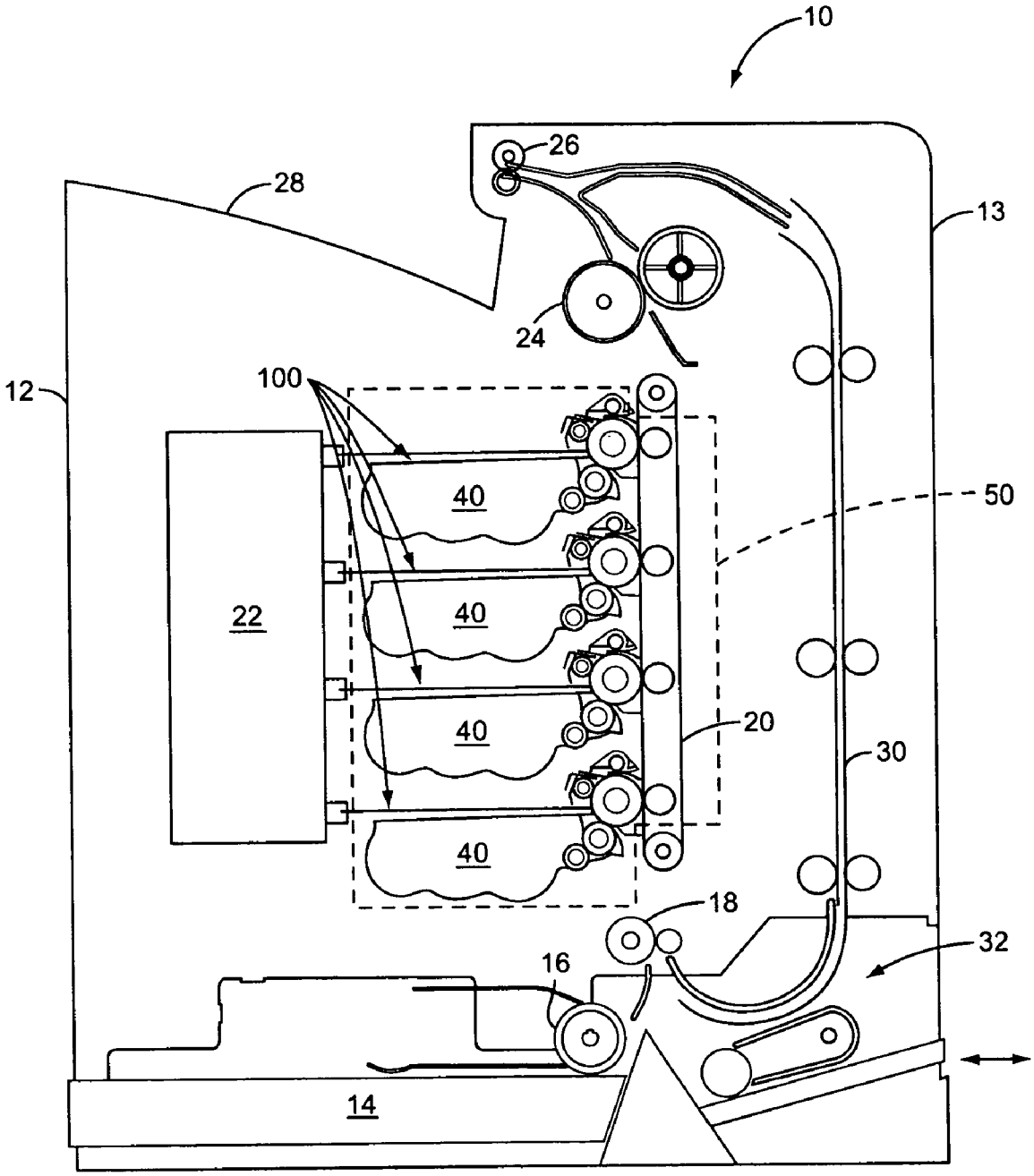
FIG. 1 is a schematic view of one embodiment of an image forming device constructed according to the present invention.

FIG. 1 depicts a representative image forming device 10. According to one embodiment of the present invention, the image forming device 10 is a color laser printer. Other examples of an image forming device include but are not limited to an ink-jet printer, fax machine, copier or any combination thereof. However, it should be apparent to those skilled in the art that the image forming device 10 may be any device in which an image is formed on a media substrate. The image forming device 10 comprises a main body 12 and a subunit 13. A media tray 14 with a pick mechanism 16, or a manual input 32, are conduits for introducing media substrates in the device 10. The media tray 14 is preferably removable for refilling, and located on a lower section of the device 10.

Media substrates may comprise paper of any type, transparencies, labels, envelopes and the like. The media substrates are moved from the input and fed into a primary media path. One or more registration rollers 18 disposed along the media path aligns the media substrate and precisely controls its further movement along the media path. A media transport belt 20 forms a section of the media path for moving the media substrates past an image transfer assembly 50. The image transfer assembly 50 includes a plurality of image forming units 100.

As illustrated in FIG. 1, the image forming device 10 includes four image forming units 100 for transferring print material on the media substrate to produce a full-color image. The image forming units 100 are disposed along a vertical plane. However, it will be appreciated by those skilled in the art that the image forming units may be disposed along a horizontal plane or any other orientation. The print material typically comprises toner of varying colors. For illustrative purposes, the image forming units 100 include cyan, magenta, yellow, and black toner to produce a full-color image on the media substrate.

An imaging device 22 forms an electrical charge on a photoconductive unit 102 (see FIG. 2) within the image forming units 100 as part of the image formation process. The term "imaging device" refers to a device that arranges an electrical charge on the photoconductive unit 102. Various imaging devices may be used such as a laser printhead or a LED printhead. The media substrate with loose toner from one or more of the image forming units 100 is then moved through a fuser 24 that adheres the toner to the media substrate. Exit rollers 26 rotate in a forward or a reverse direction to move the media sheet to an output tray 28 or a duplex path 30. The duplex path 30 directs the inverted media substrate back through the image formation process for forming an image on a second side of the media substrate.

The image forming units 100 each include an exterior housing 40 that forms a reservoir for holding a supply of toner of each appropriate color. One or more agitating members (not shown) are positioned within the reservoir for agitating and moving the toner towards the media substrate.

Figure 2:
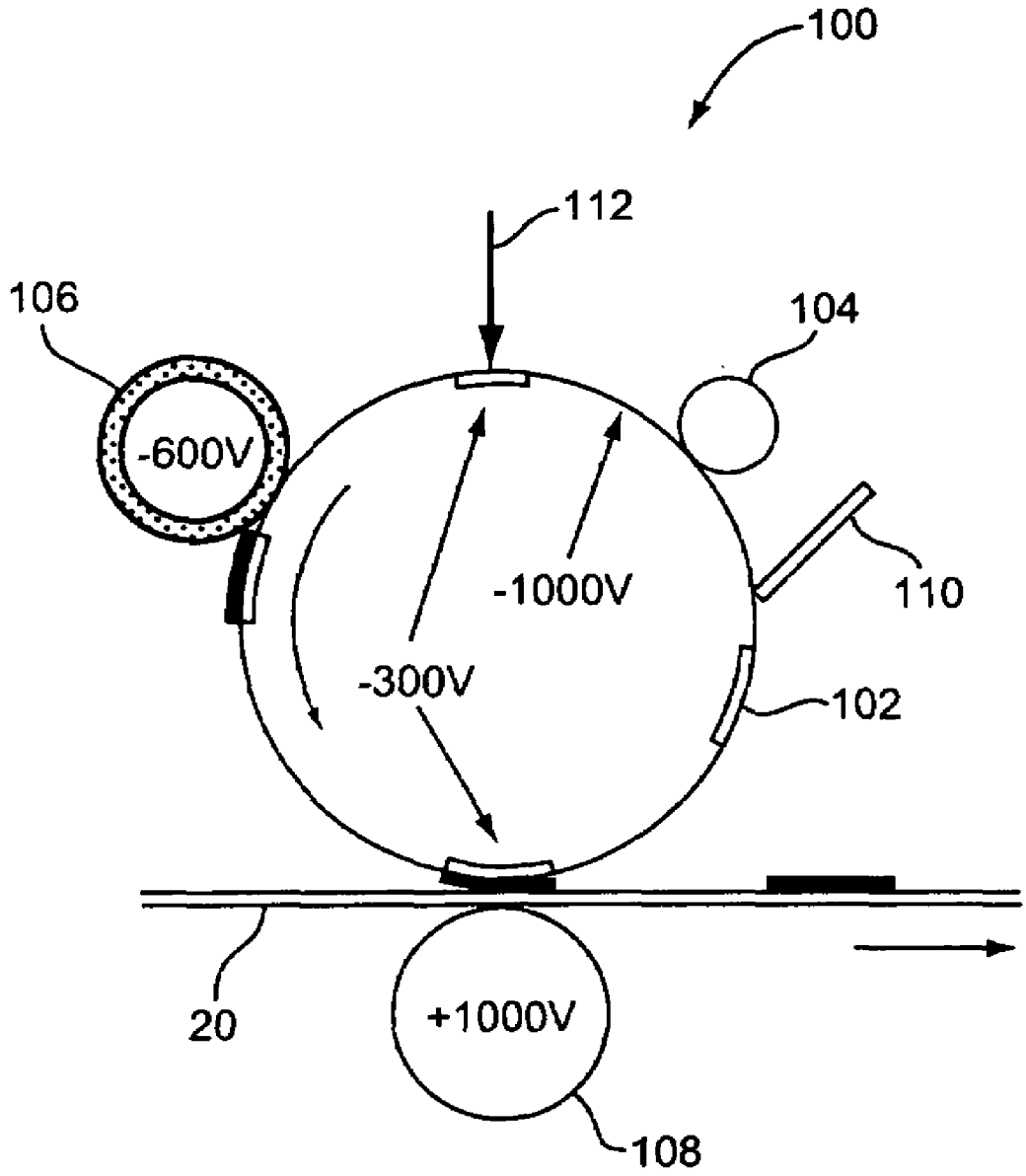
FIG. 2 is a schematic view illustrating an image forming unit of the image forming device of FIG. 1.

FIG. 2 is a schematic diagram illustrating an exemplary image forming unit 100. Each image forming unit 100 includes a photoconductive (PC) unit 102, a charging unit 104, a developer roll 106, a transfer device 108, and a cleaning blade 110. The PC unit 102 is cylindrically shaped and illustrated as a drum. However, it will be apparent to those skilled in the art that the PC unit 102 may comprise any appropriate structure. The charging unit 104 charges the surface of the PC unit 102 to a negative potential, approximately −1000 volts in the present embodiment. A laser beam 112 from the imaging device 22 (see FIG. 1) discharges areas on the PC unit 102 to form a latent image on the surface of the PC unit 102. The areas of the PC unit 102 illuminated by the laser beam 112 are discharged resulting in a potential of approximately −300 volts in the present embodiment. The PC unit core is held at approximately −200 volts while the transfer device 108 is charged at a predetermined positive potential.

In the present invention, the potential of the transfer device 108 may vary depending on the type of media substrate and the color of the toner being applied to the media substrate as discussed further herein. The developer roll 106 transfers negatively-charged toner having a core voltage of approximately −600 volts to the surface of the PC unit 102 to develop the latent image on the PC unit 102. The toner is attracted to the most positive surface, i.e., the area discharged by the laser beam 112. As the PC unit 102 rotates, a positive voltage field produced by the transfer device 108 attracts and transfers the toner on the PC unit 102 to the media substrate. Alternatively, the toner images could be transferred to an intermediate transfer member (ITM) and subsequently from the ITM to the media substrate. Any remaining toner on the PC unit 102 is then removed by the cleaning blade 110. The transfer device 108 may include a roll, a transfer corona, transfer belt, or multiple transfer devices, such as multiple transfer rolls. The area between the PC unit 102 and the transfer device 108 is known as a transfer nip.

Figure 3:
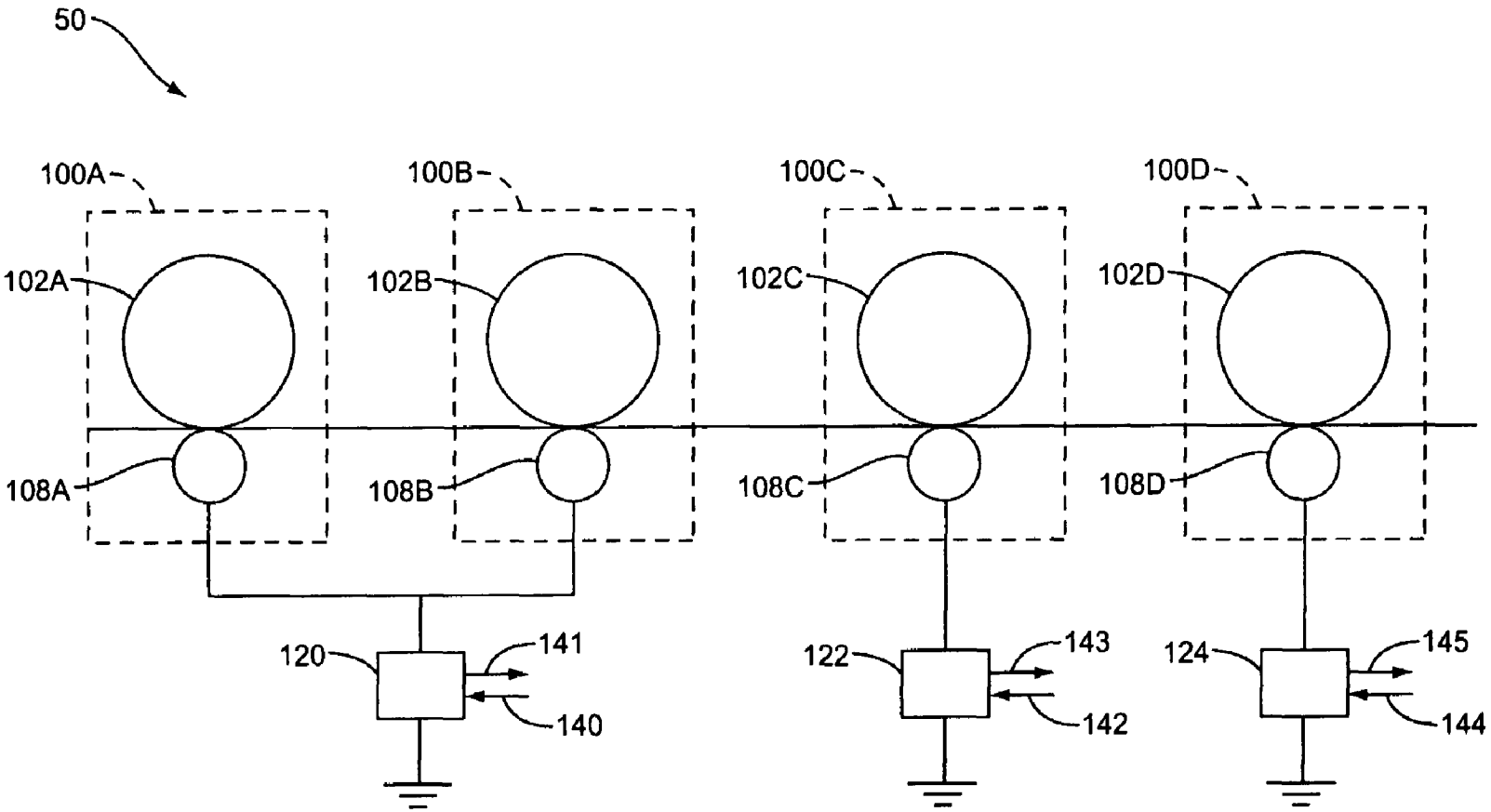
FIG. 3 is a block diagram of an image transfer assembly of the image forming device of FIG. 1.

Referring now to FIG. 3, the image transfer assembly 50 comprises four image forming units 100A-100D. In one embodiment of the present invention, the first image forming unit 100A contains black toner, the second image forming unit 100B contains yellow toner, the third image forming unit 100C contains magenta toner and the fourth image forming unit 100D contains cyan toner. However, it will be apparent to those skilled in the art that the location of the toner as well as the exact color of the toner may vary. Each image forming unit 100A-100D comprises corresponding PC units 102A-102D and transfer devices 108A-108D. A voltage is applied to the transfer devices 108A, 108B of the first and second image forming units 100A, 100B using a shared high voltage power supply 120. Similarly, a voltage is applied to the transfer device 108C of the third image forming unit 100C using a second high voltage power supply 122 and a voltage is applied to the transfer device 108D of the fourth image forming unit 100D using a third high voltage power supply 124.

The process of transferring an image onto the media substrate occurs sequentially starting at the first image forming unit 100A. The desired image is transferred to the media substrate line-by-line as the above process is repeated for each image forming unit 100 to produce the desired color and image. The media substrate is moved along the primary media path and to each image forming unit 100A-100D by the media transport belt 20. Accordingly, different layers of toner, starting with black and followed by yellow, magenta and cyan in the present embodiment, are added to the media substrate to produce the desired color and image. As is well known in the art, the exact color produced on the media substrate will depend on the toner transferred as well as the intensity thereof.

In most situations, the color black will be produced using black toner irrespective of the other colors. Accordingly, if the particular portion of the image is black, the other three toner colors will not be used. Conversely, if a particular portion of the image is a color other than black, black toner will not be used. Thus, for any given image, only one layer of toner will be applied to the media substrate by the first two image forming units 100A, 100B. This feature, in part, allows the first two transfer devices 108A, 108B to share the single high voltage power supply 120, significantly lowering system costs. In some applications, the image forming device 10 may be utilized by some users in black-only mode, in which only the image forming unit 100A is installed in the device 10. In other applications, the full color capabilities of the image forming device 10 will be exploited, with all image forming units 100A-100D installed. Thus, the high voltage power supply 120 may be called upon to drive either one or two image transfer devices (e.g., 108A alone or both 108A and 108B).

The transfer process is carried out by mechanically assisted electrostatic transfer. The toned image developed on each PC unit 102A-102D is transferred to the media substrate by applying a more positive charge on the media substrate than that of the toner charge. The transfer devices 108A-108D provide the necessary transfer current to charge the media substrate based on the voltage potential established by the high voltage power supplies 120, 122, 124. The impedances of transfer devices 108A-108D vary in response to a number of factors, including temperature and relative humidity. According to the present invention, the impedance of the transfer devices 108A-108D are measured by varying the voltage applied by high voltage power supplies 120, 122, 124, and monitoring the resulting transfer current. The determined impedance is then used to set the voltage of the high voltage power supplies 120, 122, 124 to achieve the proper transfer current at the transfer devices 108A-108D.

The voltages output by the high voltage power supplies 120, 122, 124 are controlled by Pulse-Width Modulated (PWM) control signals 140, 142, 144, respectively, output by a controller (not shown). PWM control is well known in the art. By altering the duty cycle of a PWM control signal, the output of a high voltage power supply 120, 122, 124 may be varied from 0V or a more negative initial voltage (at 0% duty cycle) to the power supply's maximum positive output voltage (at 100% duty cycle).

Figure 4A:
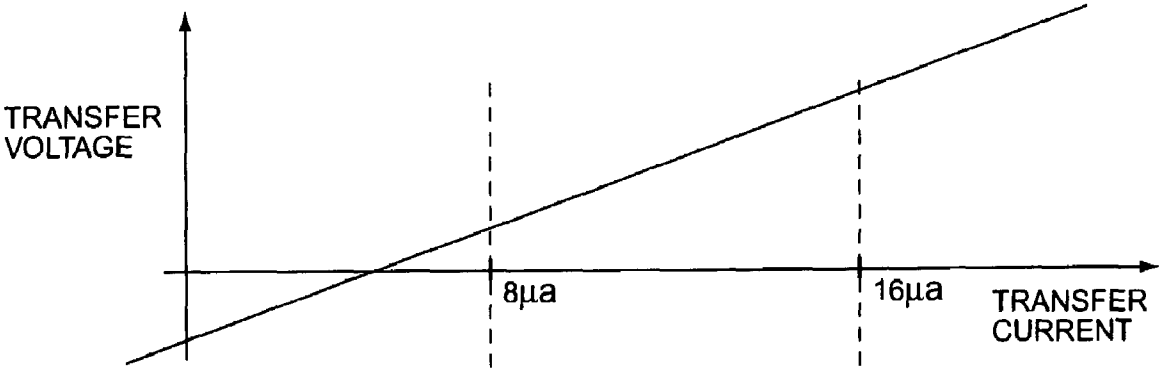
FIG. 4A is a graph of voltage and transfer current at an image forming unit.

According to one embodiment of the present invention, the voltage at a given high voltage power supply 120, 122, 124 is ramped up, by altering the duty cycle of the corresponding PWM control signal 140, 142, 144, and the resulting current through the corresponding transfer device 108A-108D is monitored. FIG. 4A depicts a graph of the transfer voltage as a function of the transfer current for a representative high voltage power supply 120, 122, 124. From this voltage/current relationship, the impedance of the corresponding transfer devices 108A-108D may be determined. This impedance may then be utilized to select the output voltage of the high voltage power supply 120, 122, 124 to yield the desired transfer current. Because the voltage/current relationship is generally linear the impedance of a transfer device 108A-108D need only be calculated at one point along the graph of FIG. 4A. This process is explained with reference to high voltage power supply 120, considering first the case of only one image transfer unit 100A installed in the image forming device 10, and then considering the case of all image transfer units 100A-100D being installed.

Figure 4B:
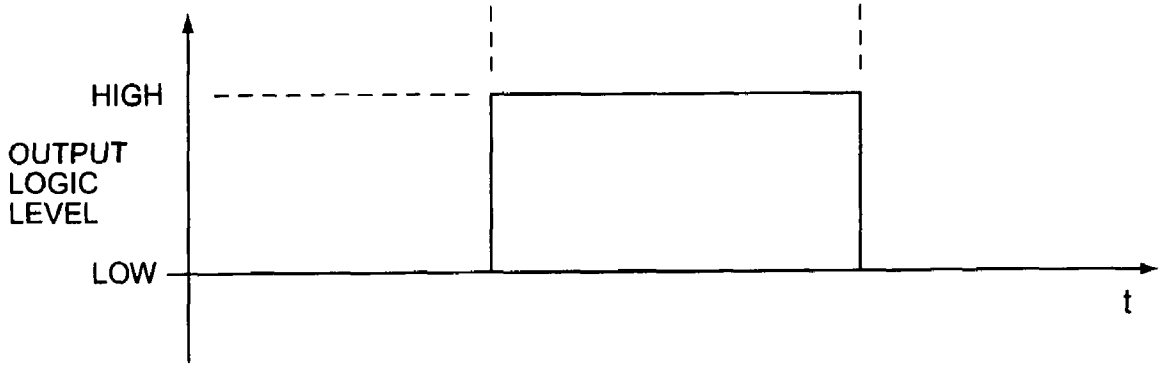
FIG. 4B is a graph of a transfer current threshold indicating signal.
Figure 5:
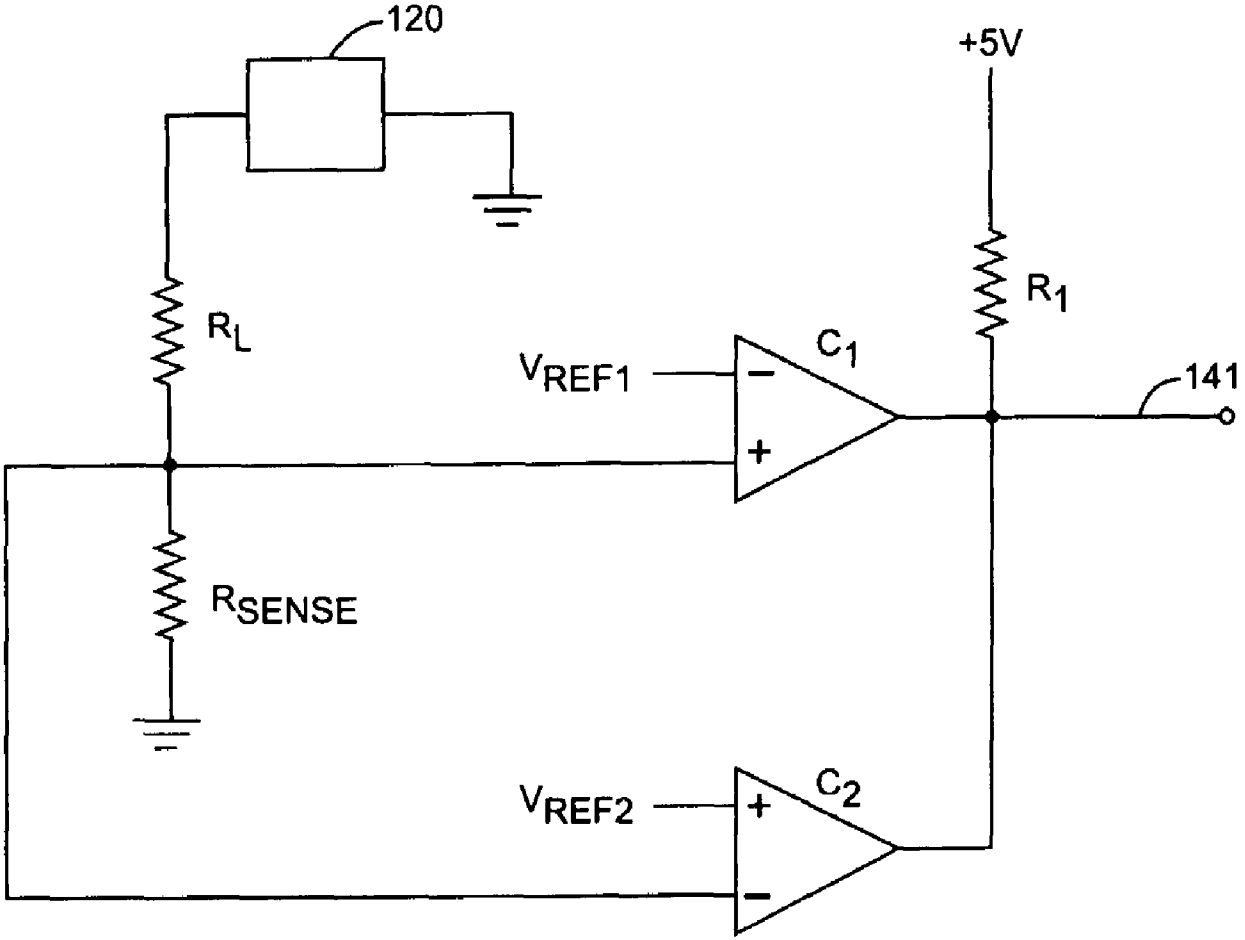
FIG. 5 is a schematic diagram of one embodiment of a transfer current threshold indicating signal generating circuit.

The output voltage of the high voltage power supply 120 is gradually ramped up by altering the duty cycle of PWM control signal 140. When the current through the transfer device 108A reaches a predetermined first transfer threshold current $I_{XFER1}$, such as 8 uA, a transfer current threshold indicating signal 141 transitions from a low to high logic level, as depicted in FIG. 4B. The generation of this signal is explained with reference to FIG. 5, depicting a functional schematic diagram of a representative transfer current threshold indicating signal generating circuit. In the circuit of FIG. 5, high voltage power supply 120 drives a resistive divider network comprising load resistance $R_L$ representing, in this case, the impedance of the transfer device 108A, and a sense resistance $R_{SENSE}$ of a predetermined value. The common node of $R_L$ and $R_{SENSE}$ is connected to the noninverting input of a first comparator $C_1$. The inverting input of the first comparator $C_1$ is connected to a first reference voltage $V_{REF1}$, wherein:

$$V_{REF1}=R_{SENSE}*I_{XFER1} \text{ or } V_{REF1}=R_{SENSE}*8 \text{ uA}$$

The output of the first comparator $C_1$ is connected to pull-up resistor $R_1$, and output to a high voltage power supply controller (not shown).

The operation of the circuit of FIG. 5 is straightforward, and explained with reference to FIGS. 4A and 4B in the case of one image transfer device 108A. Initially, the output of the high voltage power supply 120 is low or zero, and the reference voltage $V_{REF1}$ exceeds the voltage drop across the resistor $R_{SENSE}$, resulting in a low level at the output of the first comparator $C_1$. As the high voltage power supply 120 ramps up through its output voltage values (in response to a PWM control signal), the current through transfer device 108A increases, as shown in FIG. 4A. When the current reaches the first threshold current $I_{XFER1}$ (for example, 8 uA), the voltage drop across the resistor $R_{SENSE}$ exceeds the reference voltage $V_{REF1}$, causing the output of the first comparator $C_1$ to switch from a low level to a high level.

The voltage power supply 120 controller (not shown) calculates the impedance of the transfer device 108A from the known voltage output level at the time of the first transfer threshold current $I_{XFER1}$ (such as 8 uA), as indicated by the transfer current threshold indicating signal 141. From this calculated impedance value, the controller may determine the proper output voltage for the high voltage power supply 120 to yield the desired transfer current for the transfer device 108A. This determination may be made via look-up tables, calculations according to know parametric equations or the like, as well known in the art. The circuit and method explicated above is applicable to high voltage power supplies 122 and 124, receiving PWM control signals 142, 144 to alter output voltage, and outputting transfer current threshold indicating signals 143, 145, to determine the proper output voltage to drive a desired transfer current through transfer devices 108C and 108D, respectively.

In full-color printing applications, the high voltage power supply 120 drives two image transfer devices 108A and 108B. In this case, the high voltage power supply 120 must provide transfer current to both devices 108A, 108B, and hence must provide nominally twice the transfer current (e.g., 16 uA) as in the case of a single transfer device 108A. The method of determining the impedances of the transfer devices 108A and 108B, and adjusting the output voltage of the high voltage power supply 120 accordingly to generate the desire transfer current is applicable to the case of driving two transfer devices. According to the present invention, however, a single circuit determines both transfer current thresholds and outputs a single transfer current threshold indicating signal 141 indicative of both threshold currents.

The circuit of FIG. 5 additionally includes a second comparator $C_2$. The common node of $R_L$ and $R_{SENSE}$ is connected to the inverting input of the second comparator $C_2$. The inverting input of the second comparator $C_2$ is connected to a second reference voltage $V_{REF2}$, wherein:

$$V_{REF2}=R_{SENSE}*I_{XFER2} \text{ or } V_{REF1}=R_{SENSE}*16 \text{ uA}$$

The output of the first and second comparators $C_1$, $C_2$ are connected together to form a combined transfer current threshold indicating signal 141, which is output to a controller (not shown) of the high voltage power supply 120. The output 141 is pulled high by pull-up resistor $R_1$, and effectively forms a wired-AND function between the first and second comparators $C_1$, $C_2$. That is, both $C_1$ AND $C_2$ must output a high level for the transfer current threshold indicating signal 141 to be high. Conversely, if either $C_1$ OR $C_2$ output a low level, the transfer current threshold indicating signal 141 is pulled to a low level.

In operation, the output of the second comparator $C_2$ remains high so long as the second reference voltage $V_{REF2}$ exceeds the voltage drop across the resistor $R_{SENSE}$. As the output voltage of the high voltage power supply 120 continues to increase following the low-to-high transition of the first comparator $C_1$ (indicating 8 uA transfer current), the transfer current increases. When the current reaches the second threshold current $I_{XFER2}$ (for example, 16 uA), the voltage drop across the resistor $R_{SENSE}$ exceeds the reference voltage $V_{REF2}$, causing the output of the second comparator $C_2$ to switch from a high level to a low level, pulling down the transfer current threshold indicating output signal 141, as depicted in FIGS. 4A and 4B.

Thus, the combined transfer current threshold indicating signal 141 outputs a logic low level if the transfer current is below $I_{XFER1}$ (e.g., 8 uA) or above $I_{XFER}$ (e.g., 16 uA). The combined transfer current threshold indicating signal 141 outputs a logic high level if the transfer current is between $I_{XFER1}$ and $I_{XFER2}$ (e.g., 8-16 uA). The voltages at the threshold currents between $I_{XFER1}$ and $I_{XFER2}$ may be verified by ramping the output voltage of high voltage power supply 120 back down, and noting the low-to-high transition as the transfer current falls below $I_{XFER2}$ (e.g., 16 uA) and the high-to-low transition as the transfer current falls below $I_{XFER1}$ (e.g., 8 uA). Those of skill in the art will recognize that the same determinations of output voltages as the predetermined threshold transfer currents could be performed by initially setting the output voltage of the high voltage power supply 120 to a very large value by the PWM control signal 140, and gradually decreasing the output voltage while monitoring the threshold currents.

In one embodiment of the present invention, the voltage range of the first and second high voltage power supplies 120, 122 is substantially the same with a range from 0 V to 2.6 kV. In addition, the voltage range of the third high voltage power supply 124 is 0 V to 4.7 kV. The higher voltage range for the last image forming unit 100D enables reliable image transfer on highly resistive print media such as transparencies, vinyl labels and the like. Sharing the power supply for the first and second image forming units 100A, 100B and lowering the voltage range of all of the power supplies helps to reduce the overall hardware costs.

As additional layers of toner are added to the media substrate, it may be necessary to increase the voltage applied to the transfer devices 108C, 108D to compensate for the voltage potential of the already applied toner and the media substrate itself. The increased voltage allows for reliable image transfer.

Figure 6:
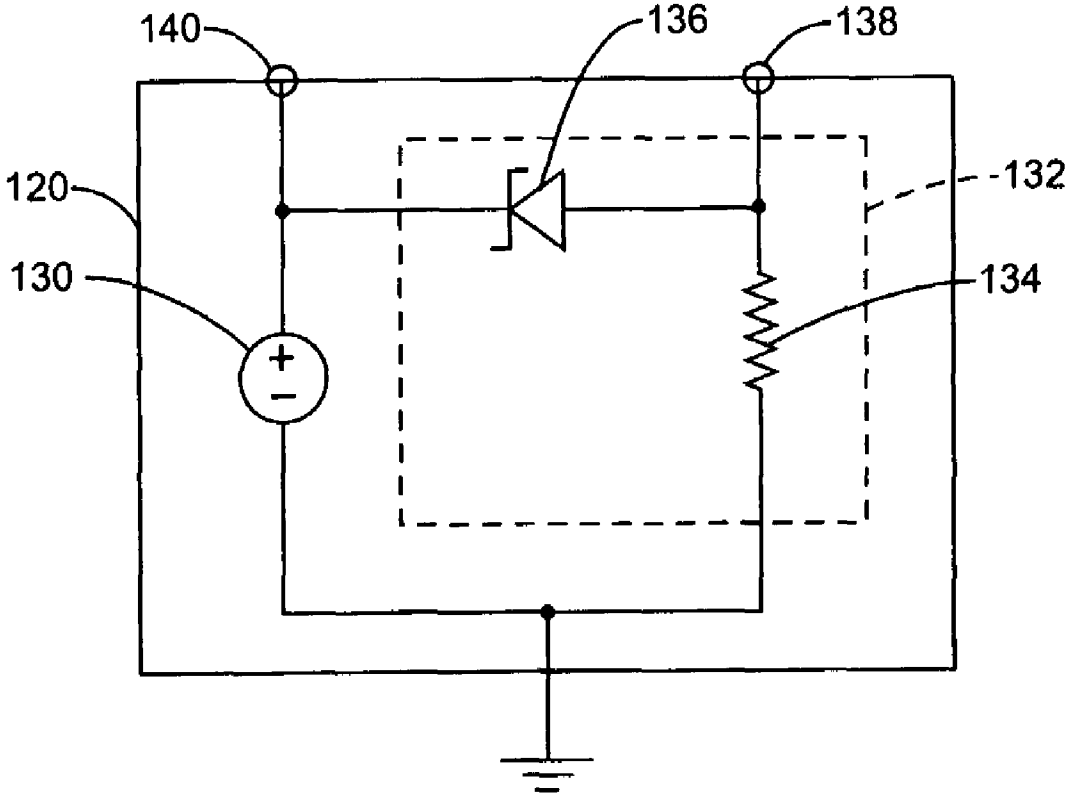
FIG. 6 is a schematic diagram of one embodiment of a power supply used in the image transfer assembly of FIG. 3.

In one embodiment of the present invention, the output voltage from the shared high voltage power supply 120 is fixed such that the voltage applied to the first two image forming units 100A, 100B is substantially the same. In another embodiment of the present invention, there may be a fixed offset between the voltages applied to the first two image units 100A, 100B. As shown in FIG. 6, the shared high voltage power supply 120 comprises a voltage supply 130 and a voltage regulator 132. The voltage regulator 132 comprises a resistive element 134 and a Zener diode 136. The voltage across the Zener diode 136 and output at port 138 is a fixed offset from the voltage generated by voltage supply 130 and output at port 140. The first transfer device 108A is coupled to port 138 while the second transfer device 108B is coupled to port 140. While the transfer devices 108A, 108B for the first and second image forming units 100A, 100B received different voltages, the voltages are supplied by the shared high voltage power supply 120.

As the image transfer process progresses, the voltages applied to the transfer devices 108A-108D may vary depending whether the media substrate is between the transfer nip or between image forming units (interpage gap). In one embodiment of the present invention, the voltage applied to the transfer devices 108A, 108B of the first and second image forming units 100A, 100B will be substantially the same with the media substrate between the transfer nips of the first two units or during the interpage gap. However, the voltage applied to the transfer devices 108C, 108D of the third and fourth image forming units 100C, 100D during the interpage gap will be lower than when the media substrate is between the transfer nip of the last two units. It will be apparent to those skilled in the art that the voltage during the interpage gap and when the media substrate is between the transfer nip may remain substantially the same for each image forming unit or vary as necessary.

The transport belt 20 is illustrated in the embodiments for moving the media sheets past the image forming units 100, and as part of the subunit 13. In another embodiment, roller pairs are mounted to the subunit 13 and spaced along the media path. The roller pairs move the media sheets past the image forming units 100. In one embodiment, each of the roller pairs are mounted on the subunit 13. In another embodiment, one of the rollers is mounted on the subunit 13, and the corresponding roller of the pair is mounted on the main body 12.

Although the present invention has been described herein with respect to particular features, aspects and embodiments thereof, it will be apparent that numerous variations, modifications, and other embodiments are possible within the broad scope of the present invention, and accordingly, all variations, modifications and embodiments are to be regarded as being within the scope of the invention. The present embodiments are therefore to be construed in all aspects as illustrative and not restrictive and all changes coming within the meaning and equivalency range of the appended claims are intended to be embraced therein.

What is claimed is:

1. An image transfer assembly for use with an image forming device, said image transfer assembly comprising:

a plurality of image forming units transferring print material to a media substrate including one black image forming unit and at least two non-black image forming units, each of said plurality of image forming units comprising a photoconductive unit and a transfer device positioned to receive the media substrate therebetween; and a first power supply coupled to said black image forming unit transfer device and at least one said non-black image forming unit transfer device but less than all of said transfer devices and supplying a voltage thereto.

2. The image transfer assembly of claim 1, wherein the voltage supplied by said first power supply is substantially the same for each of said at least two transfer devices.

3. The image transfer assembly of claim 1, wherein the voltage generated by said first power supply is different for each of said at least two transfer devices.

4. The image transfer assembly of claim 3, wherein the plurality of image forming units comprises a first image forming unit and a second image forming unit, said first image forming unit receiving said media substrate before said second image forming unit, said first image forming unit comprising a first transfer device and said second image forming unit comprising a second transfer device, said first and second transfer devices being coupled to said first power supply, wherein the voltage of the second transfer device is greater than the voltage of the first transfer device.

5. The image transfer assembly of claim 4, wherein said first image forming unit comprises black print material.

6. The image transfer assembly of claim 5, where said second image forming unit comprises yellow print material.

7. The image transfer assembly of claim 3, wherein said first power supply comprises a plurality of Zener diodes to generate the different voltages for each of said at least two transfer devices.

8. The image transfer assembly of claim 1, further comprising a second power supply coupled to another one of said transfer devices.

9. The image transfer assembly of claim 8, wherein a voltage range of said first power supply is substantially the same as a voltage range of said second power supply.

10. The image transfer assembly of claim 9, further comprising a third power supply coupled to another one of said transfer devices, wherein a voltage range of said third power supply is greater than the voltage range of said first and second power supplies.

11. The image transfer assembly of claim 1, wherein the voltage supplied to said at least two transfer devices is substantially constant during operation of said image forming device.

12. An image transfer assembly for use with an image forming device, said image transfer assembly comprising:

a first image forming unit transferring a first print material to a media substrate, said first image forming unit comprising a first photoconductive unit and a first transfer device, wherein said first print material is black;

a second image forming unit transferring a second print material to said media substrate, said second image forming unit comprising a second photoconductive unit and a second transfer device, wherein said second print material is non-black;

a third image forming unit transferring a third print material to said media substrate, said third image forming unit comprising a third photoconductive unit and a third transfer device;

a first power supply coupled to said first and second transfer devices and supplying a first voltage thereto; and a second power supply coupled to said third transfer device and supplying a second voltage thereto;

wherein said first and second voltages creates a voltage potential between respective ones of said photoconductive units and said transfer devices to facilitate the transfer of respective ones of said print material to said media substrate.

13. The image transfer assembly of claim 12, wherein the first voltage supplied to said first and second image forming units is substantially the same.

14. The image transfer assembly of claim 12, wherein said first image forming unit receives said media substrate before said second image forming unit, and wherein said first voltage supplied to said second image forming unit is greater than said first voltage supplied to said first image forming unit.

15. The image transfer assembly of claim 12, wherein said second print material is yellow.

16. The image transfer assembly of claim 12, wherein a voltage range of said first power supply is substantially the same as a voltage range of said second power supply.

17. The image transfer assembly of claim 12, further comprising:

a fourth image forming unit transferring a fourth print material to said media substrate, said fourth image forming unit comprising a fourth photoconductive unit and a fourth transfer device; and a third power supply coupled to said fourth transfer device and supplying a third voltage thereto, said third voltage creating a voltage potential between said fourth photoconductive unit and said fourth transfer device to facilitate the transfer of said fourth print material to said media substrate;

wherein a voltage range of said third power supply is greater than a voltage range of said first and second power supplies.

18. An image forming device comprising:

an image transfer assembly;

a fuser; and a housing supporting said image transfer assembly and said fuser;

said image transfer assembly comprising:

a first image forming unit transferring black print material to a media substrate, said first image forming unit comprising a first photoconductive unit and a first transfer device;

a second image forming unit transferring yellow print material to said media substrate, said second image forming unit comprising a second photoconductive unit and a second transfer device;

a third image forming unit transferring one of cyan and magenta print material to said media substrate, said third image forming unit comprising a third photoconductive unit and a third transfer device;

a fourth image forming unit transferring the other of cyan and magenta print material to said media substrate, said fourth image forming unit comprising a fourth photoconductive unit and a fourth transfer device;

a first power supply coupled to said first and second transfer devices and supplying a first voltage thereto;

a second power supply coupled to said third transfer device and supplying a second voltage thereto; and a third power supply coupled to said fourth transfer device and supplying a third voltage thereto;

wherein said first, second and third voltages create a voltage potential between respective ones of said photoconductive units and said transfer devices to facilitate the transfer of respective ones of said print material to said media substrate, said fuser causing said print material to bond to said media substrate.

19. The image forming device of claim 18, further comprising a transport belt coupled to said housing and moving said media substrate to each of said image forming units.

20. The image forming device of claim 18, wherein a voltage range of said first power supply is substantially the same as a voltage range of said second power supply.

21. The image forming device of claim 18, wherein a voltage range of said third power supply is greater than a voltage range of said first and second power supplies.

22. A method of supplying power to an image forming device, said image forming device comprising an image transfer assembly, said image transfer assembly comprising a black image forming unit and a plurality of non-black image image forming units, each of said image forming units comprising a photoconductive unit and a transfer device positioned to receive a media substrate therebetween, said method comprising:

supplying a voltage to said black image forming unit transfer device and at least one said non-black image forming unit transfer device but less than all of said non-black image forming unit transfer devices from a single power supply creating a voltage potential between respective one of said photoconductive units and said transfer device to facilitate the transfer of print media to said media substrate.

23. The method of claim 22, wherein supplying a voltage to at least two but less than all of said transfer devices from a single power supply creating a voltage potential between respective one of said photoconductive units and said transfer device to facilitate the transfer of print media to said media substrate comprises supplying substantially the same voltage for each of said at least two transfer devices.

24. The method of claim 22, wherein supplying a voltage to at least two of said transfer devices from a single power supply creating a voltage potential between respective one of said photoconductive units and said transfer device to facilitate the transfer of print media to said media substrate comprises supplying a different voltage for each of said at least two transfer devices.

25. The method of claim 22, further comprising supplying a voltage from a second power supply to another one of said transfer devices, wherein a voltage range of said single power supply is substantially the same as a voltage range of said second power supply.

26. The method of claim 25, further comprising supplying a voltage from a third power supply to another one of said transfer devices, wherein a voltage range of said third power supply is greater than the voltage range of said single power supply and said second power supply.

27. The method of claim 22, wherein the voltage supplied by said single power supply is substantially constant during operation of said image forming device.

28. A method of printing with a plurality of image forming units comprising:

moving a media substrate to a first image forming unit, said first image forming unit comprising a black image forming unit;

applying a first voltage from a first power supply to said first image forming unit facilitating the transfer of a first print material from said first image forming unit to said media substrate;

moving said media substrate to a second image forming unit, said second image forming unit comprising a non-black image forming units;

applying said first voltage from said first power supply to said second image forming unit facilitating the transfer of a second print material from said second image forming unit to said media substrate, said first power supply applying said first voltage to less than said plurality of image forming units;

moving said media substrate to a third image forming unit; and applying a second voltage from a second power supply to said third image forming unit facilitating the transfer of a third print material from said third image forming unit to said media substrate.

29. The method of claim 28, further comprising moving said media substrate to a fourth image forming unit and applying a third voltage from a third power supply to said fourth image forming unit facilitating the transfer of a fourth print material from said fourth image forming unit to said media substrate.

* * * * *